US010595657B1

(12) United States Patent
Yoder et al.

(10) Patent No.: US 10,595,657 B1
(45) Date of Patent: Mar. 24, 2020

(54) USARMOURBOX™ MAILBOX SYSTEM

(71) Applicant: Yoder Design, LLC, Sylvania, OH (US)

(72) Inventors: Brian Yoder, Sylvania, OH (US); Bruce Yoder, Denver, CO (US)

( * ) Notice: Subject to any disclaimer, the term of this patent is extended or adjusted under 35 U.S.C. 154(b) by 46 days.

(21) Appl. No.: 15/596,450

(22) Filed: May 16, 2017

Related U.S. Application Data

(60) Provisional application No. 62/337,540, filed on May 17, 2016.

(51) Int. Cl.
*A47G 29/12* (2006.01)

(52) U.S. Cl.
CPC ..... *A47G 29/1216* (2013.01); *A47G 29/1203* (2013.01)

(58) Field of Classification Search
CPC ..... A47G 29/1216; A47G 29/1203; A47G 29/121; A47G 29/1209; A47G 29/12095; F16M 11/08; F16M 2200/024
USPC ..... 232/17, 38, 39, 45, 10, 1 C; 248/131, 248/415, 417, 418; D99/29–32
See application file for complete search history.

(56) References Cited

U.S. PATENT DOCUMENTS 674,147 A * 5/1901 Wirt ..... A47G 29/1209 232/17
1,629,939 A * 5/1927 Turner ..... B60N 2/502 248/418
2,025,251 A * 12/1935 Steinbronn ..... A47G 29/1209 232/34
3,975,050 A * 8/1976 McKee ..... A47C 1/026 297/328
D330,793 S * 11/1992 Hampton ..... D99/32
D342,367 S * 12/1993 Lamancusa ..... D99/30
5,445,086 A * 8/1995 Bolduc ..... A47G 29/1216 232/39
D423,756 S * 4/2000 Borer ..... D99/30
D426,045 S * 5/2000 Bien ..... D3/255
D432,754 S * 10/2000 Masciovecchio ..... D99/30
D460,599 S * 7/2002 Wrob ..... D99/30
D478,201 S * 8/2003 Hostetler ..... D99/30
D484,668 S * 12/2003 Morgan ..... D99/29
D488,610 S * 4/2004 Coleman ..... D99/30
6,974,073 B1 12/2005 Snyder
D548,925 S * 8/2007 Haberman ..... D99/30
7,364,066 B1 4/2008 Wilson
D575,475 S * 8/2008 Gregory ..... D99/30
7,611,044 B1 * 11/2009 Wilson ..... A47G 29/1209 232/17

* cited by examiner

*Primary Examiner* — William L Miller
(74) *Attorney, Agent, or Firm* — Schaffer, Schaub & Marriott, Ltd.

(57) ABSTRACT

The present is directed to a "virtually indestructible" mailbox which has a dome shaped end directed to destructive snow plow road work, anti-destructive armour shape is to propel any incoming impact forces and to be absorbed into the circular body by transferring impact loads into the tubular armour bullet-like shape. The mailbox as a vault, having a circular plan and in the form of a spherical dome, so constructed as to exert an equal impact load into armour shape shell body.

18 Claims, 9 Drawing Sheets

USARMOURBOX™ MAILBOX SYSTEM

CROSS REFERENCE TO RELATED APPLICATION

The present patent application is based upon and claims the benefit of provisional patent application No. 62/337,540 filed on May 17, 2016.

FIELD OF THE INVENTION

The present invention relates to mailbox systems that are resistant to damage. The systems are especially resistant to heavy snow and slush projections from snowplows. USARMOURBOX™ is a trademark represented by trademark U.S. Pat. No. 86,932,044 filed Mar. 8, 2016.

BACKGROUND OF THE INVENTION

In areas where curb side mail delivery is required, such as townships and unincorporated resident and business mailboxes, with road speed limits exceeding 25 mph, snow plow trucks have enough speed to push snow off the road to create airborne snow loads causing severe damage to standard mailboxes and mounting posts.

The present invention has a unique structural design and incorporates United States mail design standards in function and size limitations.

Prior to the invention, mailboxes did not utilize an architectural form and structural theory to protect the mailboxes from destructive elements such as snow plow roadway work.

Although there are prior mailboxes that utilize a static aerodynamic design to protect said mailboxes from destructive elements, such as weather and flying projectiles, the USARMOURBOX™ system employs a dynamic feature which allows change in shape according to settings to accommodate seasonal road maintenance of snow plow snow removal.

SUMMARY OF THE INVENTION

The present invention is "virtually indestructible". The mailbox incorporates typical architectural geometric shapes formed with aluminum sheet metal for armour type strength. The design protects the mailbox from snow loads projected from snow plows when the invention is transformed by rotation of the mailbox to face into the direction of destructible forces from snow plows. The invention has two designs which make it unique. Pivotal components adjust for winter destructive mode. In summer, other destructive objects result from roadside unpredictable objects. Illustrated figures represent the unique secondary mail hatch opening. This end section of the round box has the same function as incorporated on traditional mailbox hatch openings.

The present invention's unique structural shape consists of i) an circular amour round tube shape and ii) a "bullet" shaped horizontal design. These are structurally incorporated into shape with a dome structure.

The architectural portion of a half sphere, dome shape, is so constructed as to exert an equal thrust in all directions. The mail vault, vault structure, dome, and architectural shape provide unity between the dwelling unit with said mailbox utilitarian form follows function theory.

The transformed traditional box shape with barrel vault top to shed snow and water into a circular tube extruding the backside into a dome shape. In architectural theory, the practice of utilizing a geometric shape is to disperse applied loads in the horizontal forces associated with forces of a road side snow plow removing snow from roadways.

In another preferred embodiment, a unique mailbox post allows the mailbox to be rotated and locked into a place in its "winter" mode, so that the dome shaped end is directed towards the snow and slush from snow plows.

BRIEF DESCRIPTION OF THE DRAWINGS

The invention can be further understood with coordinating views and additional description. The figures are represented to scale which will contribute to understanding the shapes geometry in relation to how the invention will function in true environments.

DETAILED DESCRIPTION OF THE INVENTION

The employment of given certain geometric forms used to resist structural forces can be found in circular forms of plutonic shapes such as the incorporated hollowed metal half sphere dome.

Figure 1:
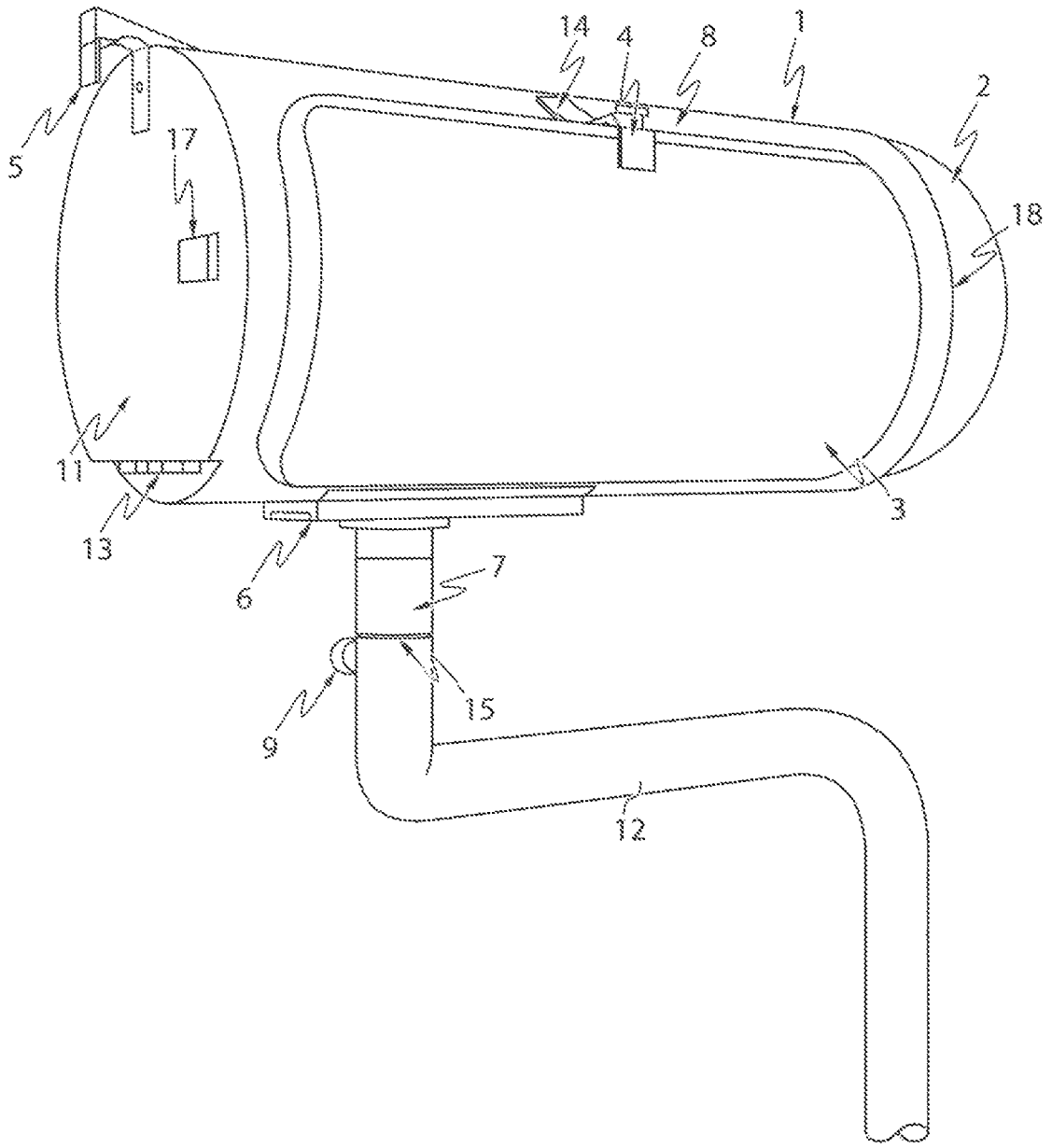
FIG. 1 is a perspective view of the USARMOURBOX™ mailbox of this invention.

Referring to drawings, FIG. 1 illustrates the blast force resistive shape designed to virtually resist snow plow blast with the "indestructible" mailbox referred to in the Figs.

The present is directed to an 'indestructible' mailbox which has a dome shaped end directed toward destructive snow plow road work, anti-destructive armour shape is to deflect any oncoming impact forces and to absorb said forces into the circular shaped body.

The bullet-like shape is a vault, having a circular plan and usually in the form of a portion of a sphere, so constructed as to exert an equal thrust in all directions.

LIST OF COMPONENTS

1. Mailbox shell main body round tube shape rolled aluminum plate with one continuous welded seam located underneath main body.
2. Geometric dome end, stamped diamond aluminum plate or construction options such as in incorporated into aircraft nose cone of spun aluminum into shape to absorb blunt impact force from roadside snow plow snow removal at speeds greater than 25 mph known to damage traditional mailbox shapes. The structural force directions implied from impact which said shape will distribute loads into adjacent tube geometric form. If required, will be locations of additional truss like ribs to provide the required additional structural requirements to absorb impact loads.

3. Winter or expected snow removal is shown with side hatch rotated to be the front hatch for roadside mail delivery access. Section of round tube extracted and offset with friction water tight flanges, closing and opening latch sized in length will be determined on force resistant requirements for impact testing. Attached to the main body by 14 a nautical boat hatch type hinge to assist in water tightness closure.

4. Latch, shaped as a pull with grasping ability positioned to friction fit into 14 receiver latch attached to main body incorporated into nautical boat hatch type flange for water tightness.

a. Same as 4 shown in open position.

5. "Summer" hatch latch, grasp handle which friction fits into opposite above female shape component.

6. Two piece support.

7. Support and post receiver.

8. Side hatch flange receiver, watertight seam.

9. Button spring pop latch for locking "summer" and "winter" position.

10. Represents the floor of mailbox 1.

11. Summer mode mail hatch, rolled aluminum plate, friction fit between components 16 for water tight seam. Stamped die text MAIL.

12. Support post, 2" diameter aluminum pipe bent to shape to positions for versatile rotated mailbox.

13. "Summer" hatch mechanical hinge, pivot points, water tight seams.

14. "Winter" hatch locking point, female shape to receive 4 opposite shape providing friction fit.

15. Rotating point between "summer" and "winter" mode, extruded make post into 12 post with button pop lath or removable pin.

16. Summer hatch outside flange to incorporate receiving 11 movable hatch into flange as a friction fit male component and water tight seam.

17. Formed plastic flag shape per standard height and size, plastic to resist bending and breakage from snow impacts. Rotates 90 degrees to position out and in.

18. Seam interlock snap joint or aluminum welded connection, tube to dome shape.

19. Newspaper accessory fitting. Component 12 option to have same pipe with inverted attachment to receive newspaper option tube of same form reduced in scale to receive newspaper.

20. Dome shape end same function as described in FIGS. 1*a* and 1*b*.

21. Tube shape newspaper container same as described for the systems shape and function.

22. Center axis rotation of invention "summer" and "winter" positions.

23. Reflector

24. Attachment

25. Shell

FIG. 1 is a perspective view of the USARMOURBOX™ mailbox of this invention. FIG. 1 shows mailbox main body 1 having geometric dome end 2, and "summer" hatch 5. Also shown is "summer" hatch mechanical hinge 13, "summer" hatch outside flange 16, formed plastic flag 17 and seam interlock 18.

FIG. 1 also shows the mailbox resistant to damage comprising:

a main body of a continuous round tube shaped plate;

a "summer" mode mail hatch attached to a first end of the main body, wherein the "summer" mode mail hatch has a friction fit, water tight seam;

a "winter" mode mail hatch attached to a side of the main body, wherein the "winter" mode mail hatch has a friction fit, water tight seam; and a second end of the main body opposite the first end wherein the second end has a tubular, bullet shape.

Figure 2:
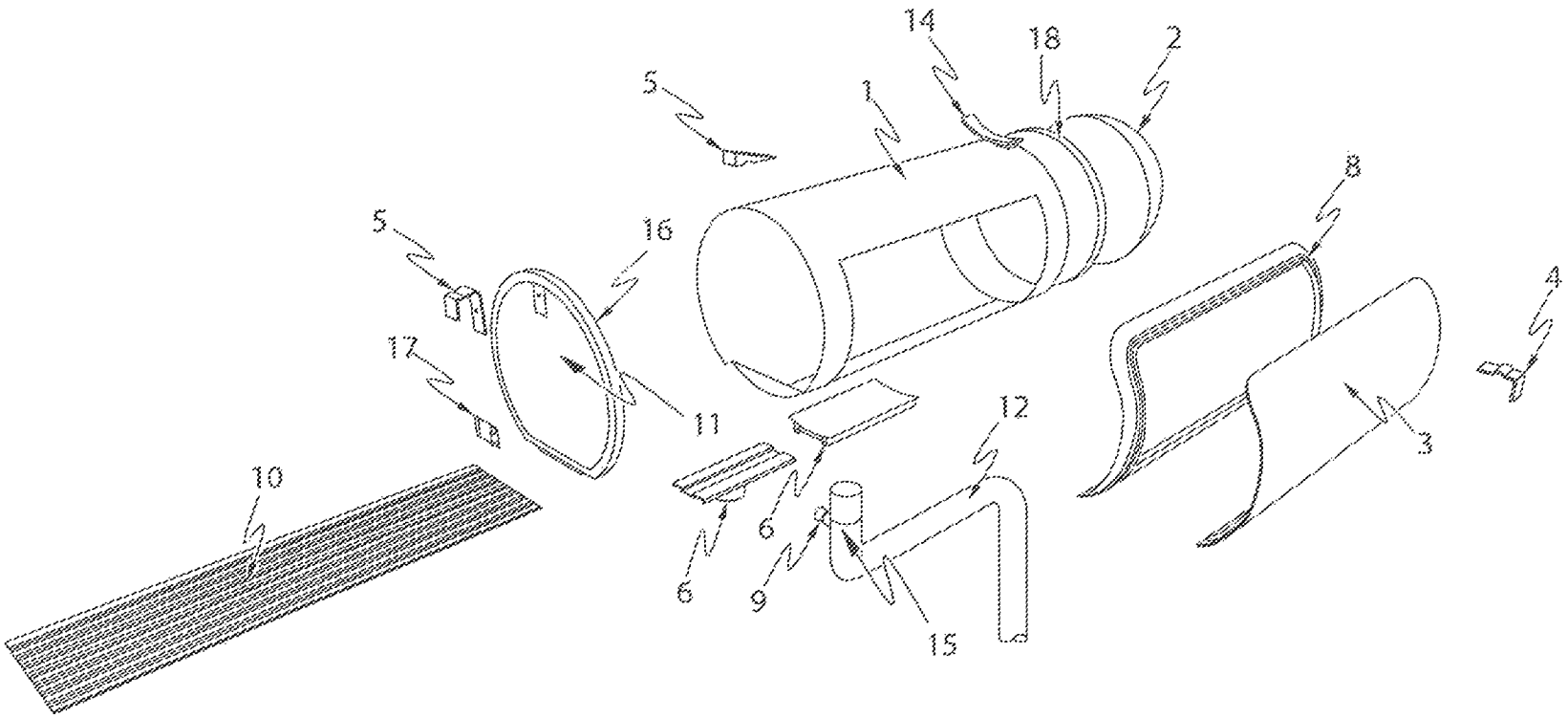
FIG. 2 is an exploded view f the mailbox of FIG. 1.
Figure 3:
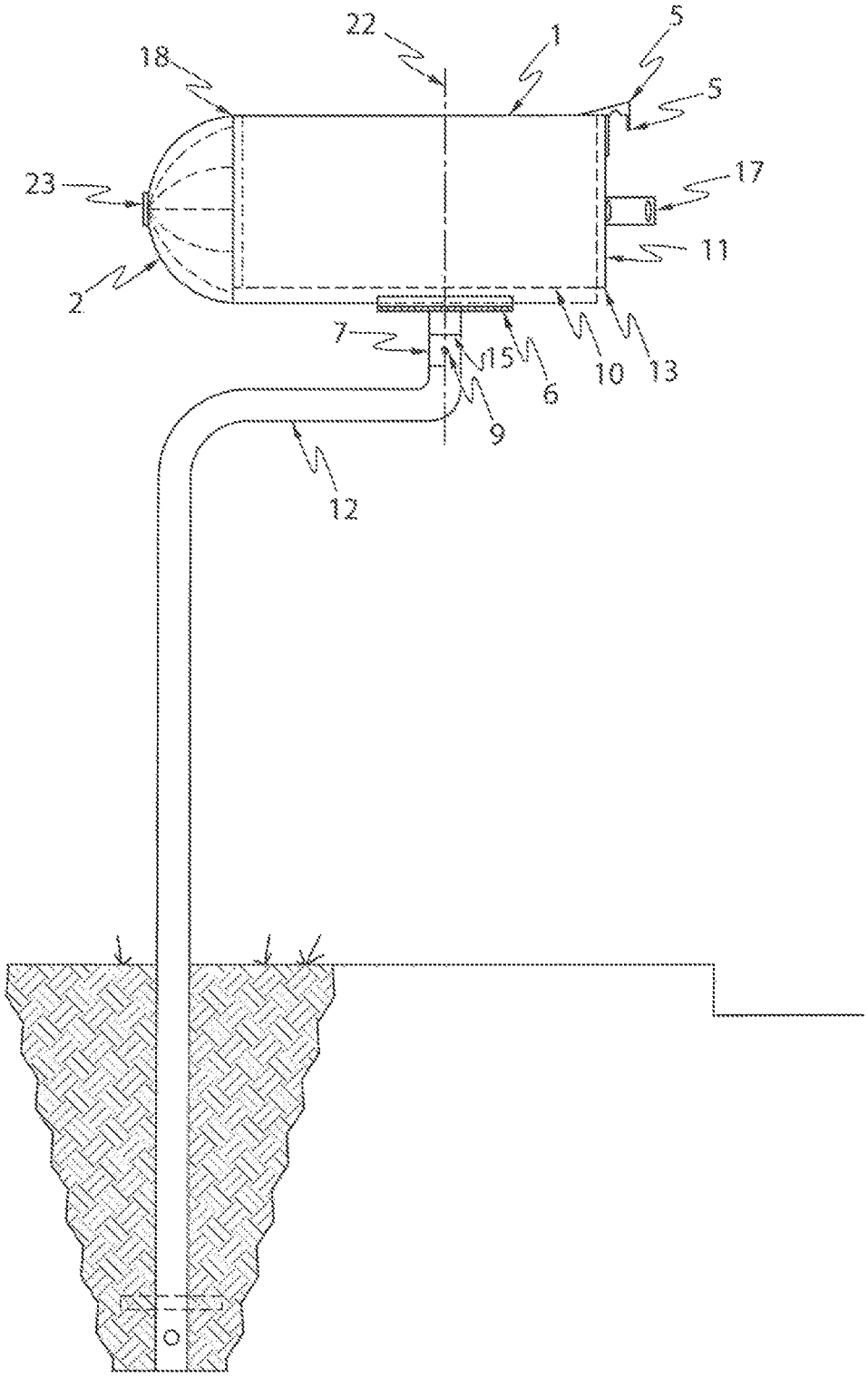
FIG. 3 is a side view of the mailbox system of this invention in "summer" mode.

FIG. 2 is an exploded view of the mailbox of FIG. 1. Shown is additional components:

FIG. 3 is a side view of the mailbox system of this invention in "summer" mode. In addition to the components shown in FIG. 1 is button spring pop hatch 9 and support post 12. Also shown is center axis rotation of the "summer" and "winter" mode positions.

Figure 4:
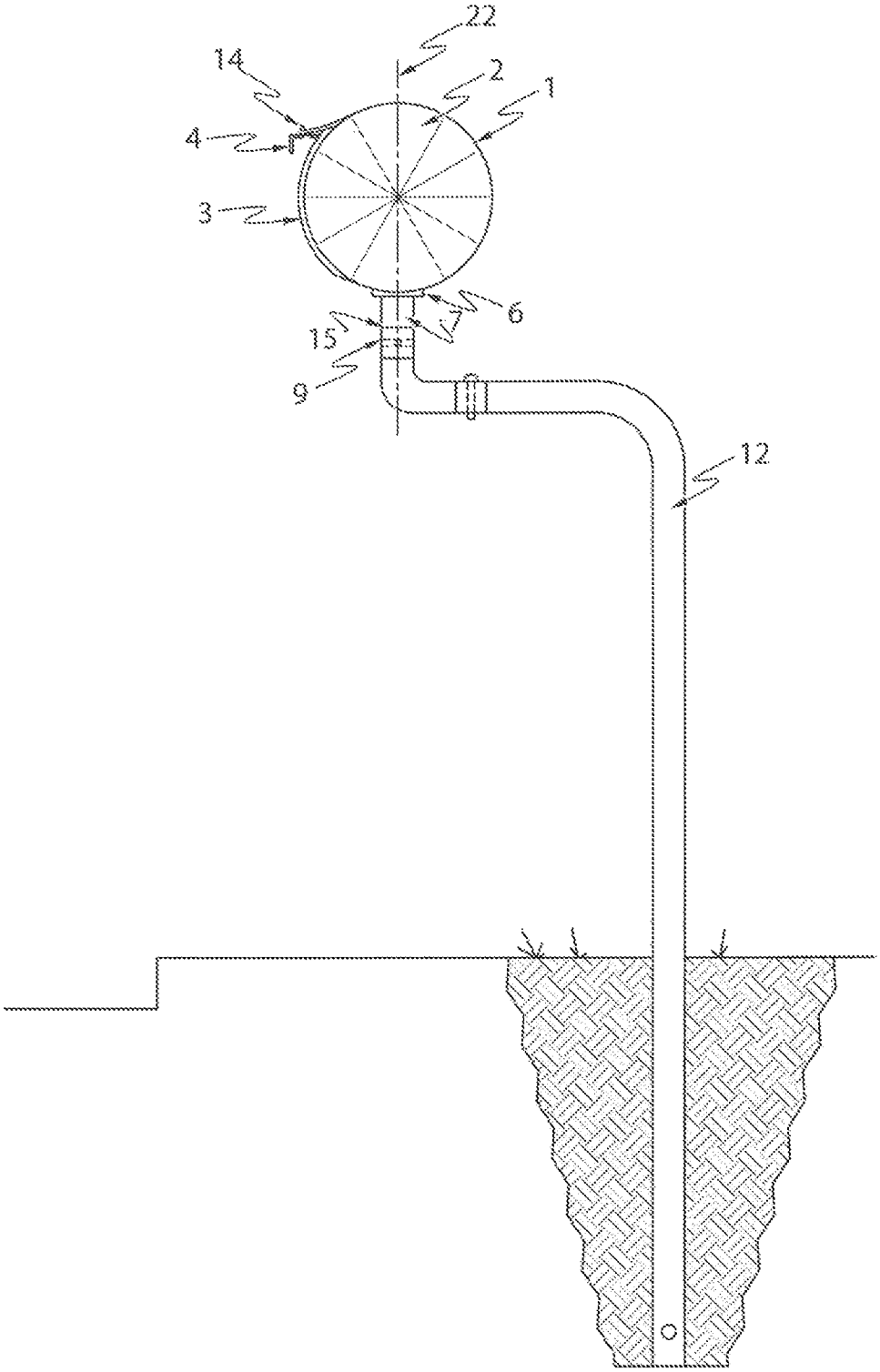
FIG. 4 is a front view showing "summer" mode mail hatch 11.

FIG. 4 is a front view showing "summer" mode mail hatch 11. "Winter" side hatch 3 is shown in phantom. Also shown is latch 4. Latch 4*a* is latch 4 shown in the open position. Also known are button spring pop latch 9. Floor 10 of mailbox 1 is shown in phantom.

Figure 5:
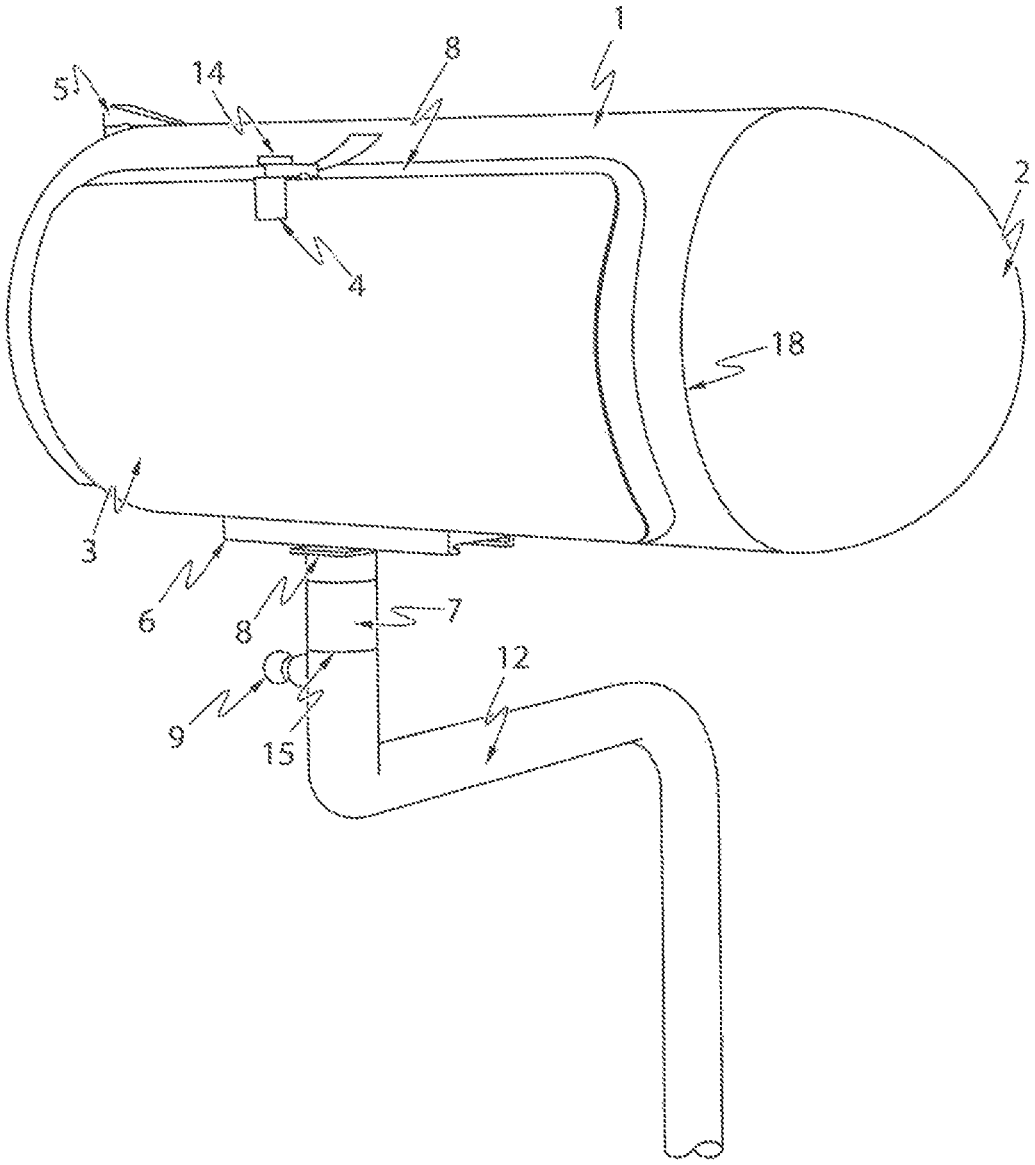
FIG. 5 is a side view showing "winter" mode hitch 3 in greater detail.

FIG. 5 is a side view showing winter mode hatch 3 in greater detail. Newspaper tube 21 is shown in phantom.

Figure 6:
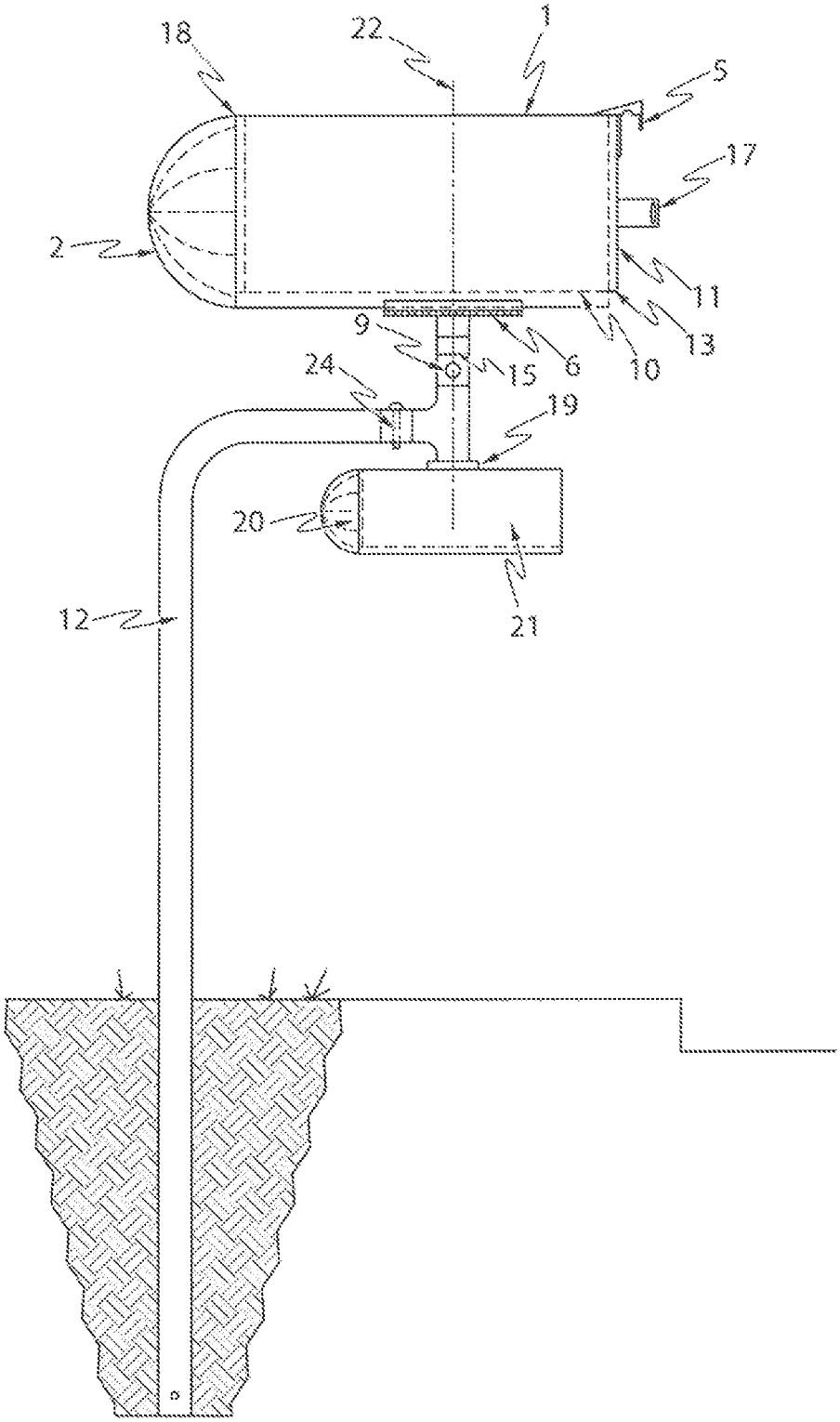
FIG. 6 is a side view showing same tube shape newspaper container 21.

FIG. 6 is a side view showing tube shape newspaper container 21. Container 21 has a dome shape end 20. Newspaper accessory fitting 19 and attachment 24 connects fitting 19 to support post 12.

Figure 7:
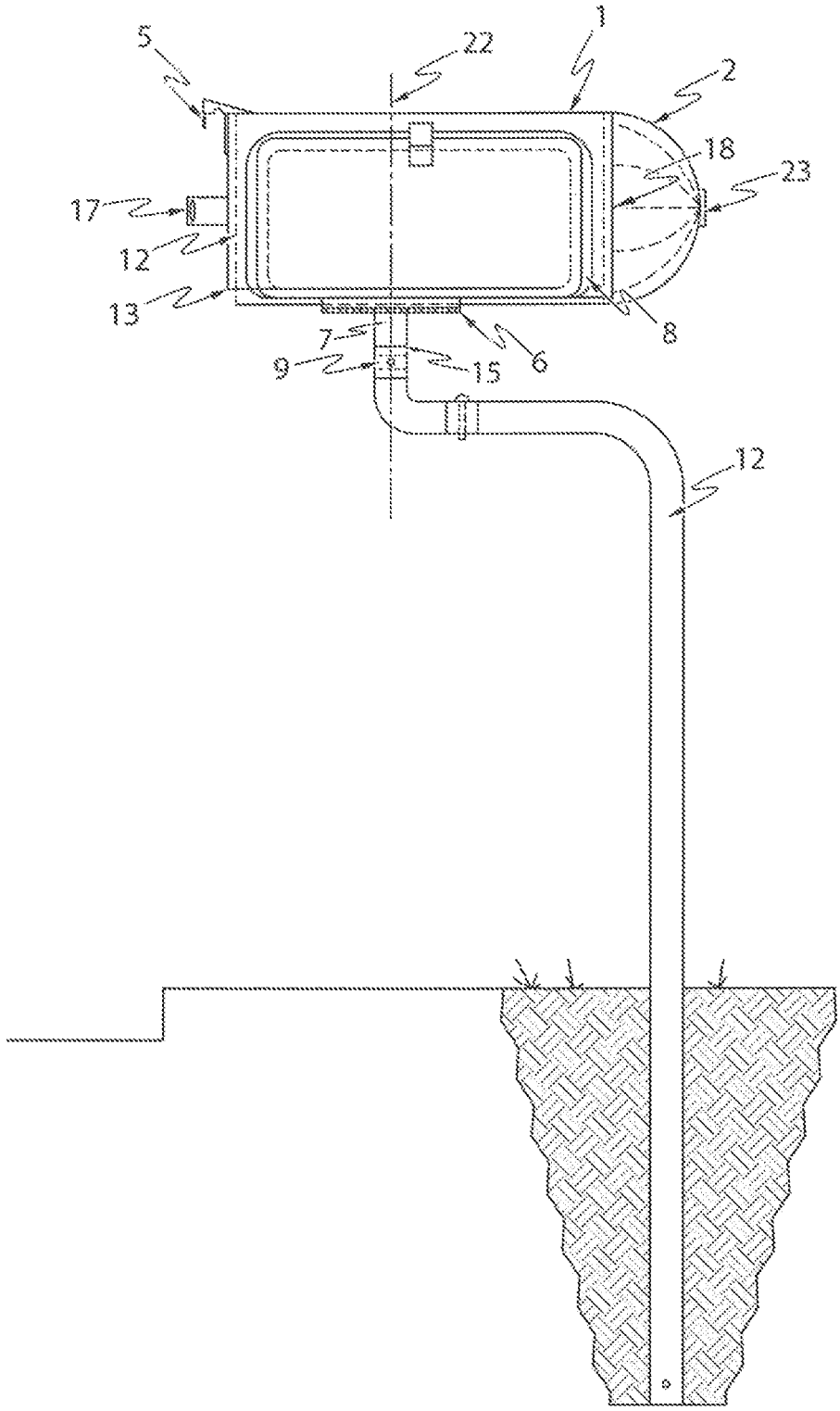
FIG. 7 is a right-side view of the mailbox system of this invention in summer mode.

FIG. 7 is a right-side view of the mailbox system of this invention in "summer" mode with "winter" mode hatch 3 facing a roadway.

Figure 8:
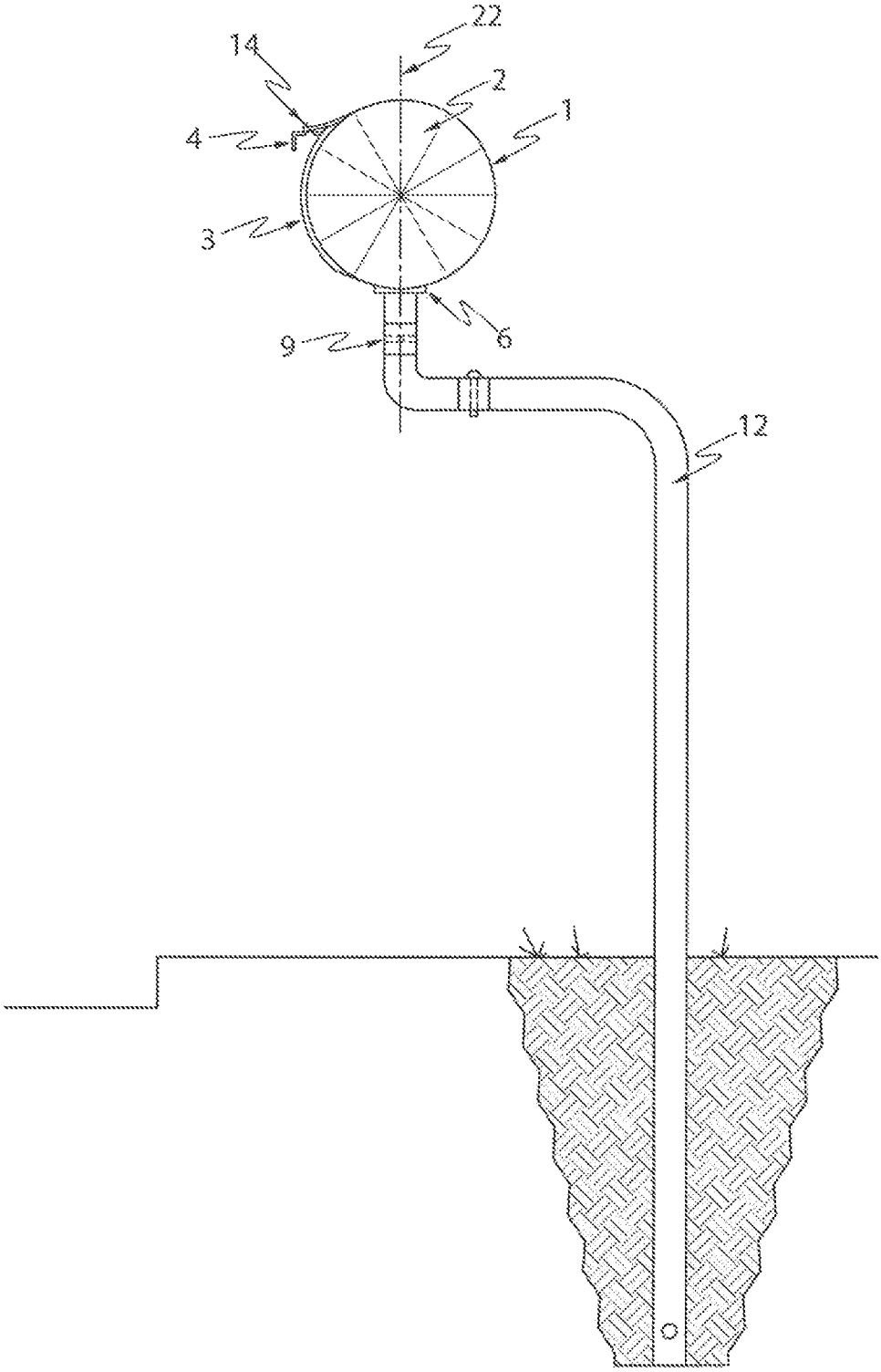
FIG. 8 is a right-side view of the mailbox system of this invention in winter mode.

FIG. 8 is a right side view of the mailbox system of this invention in "winter" mode with "summer" mode hatch 11 facing a roadway.

Figure 9:
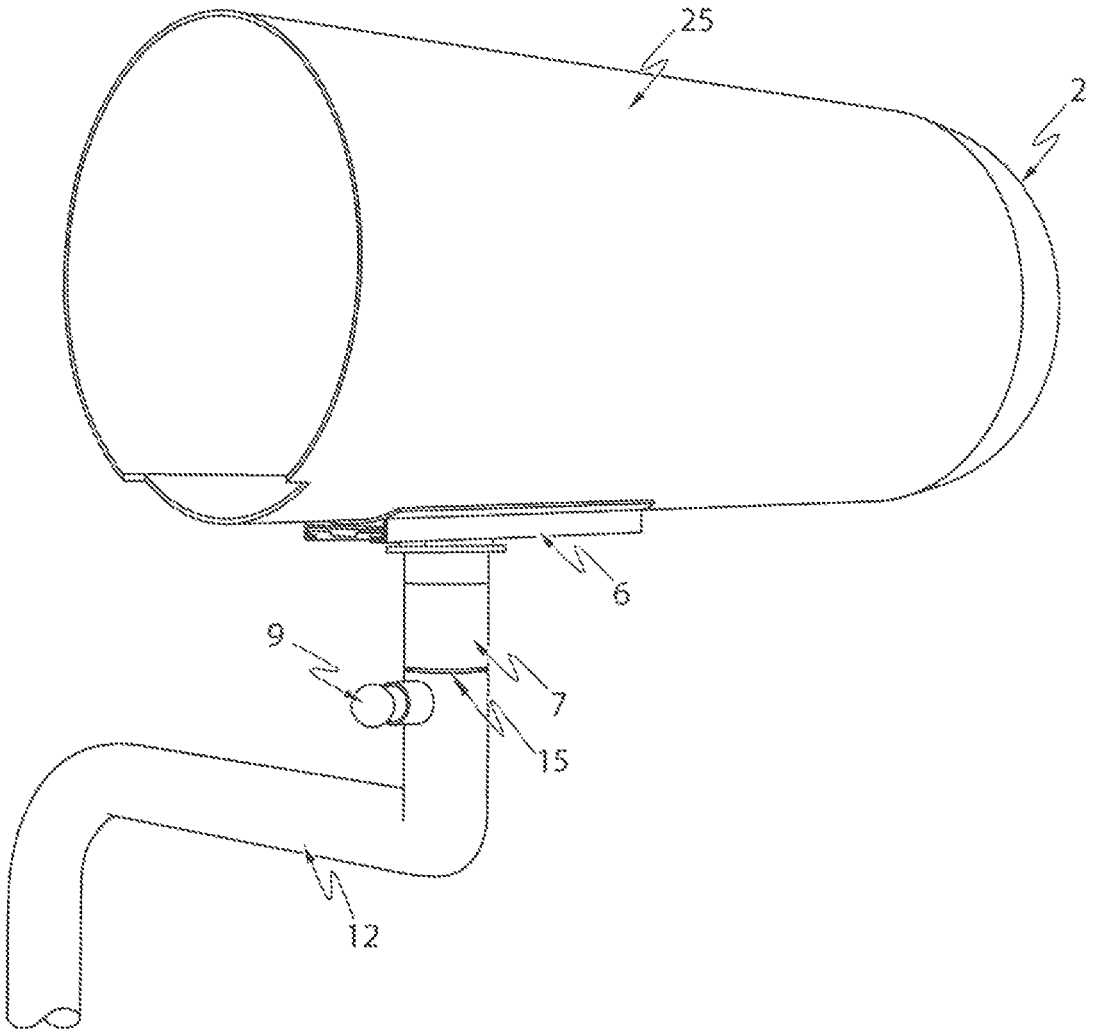
FIG. 9 is a perspective view of a shell. The shell has a tubular, bullet shape of the mailbox of this invention. The shell also is configured to house a conventional mailbox.

FIG. 9 is a perspective view of shell 25. Shell 25 has a tubular, bullet shape of the mailbox of this invention. The shell also is configured to house a conventional mailbox.

We claim:

1. A mailbox resistant to damage comprising:

a main body of a continuous round tube shaped plate defining an interior for receiving mail;

a "summer" mode mail hatch service door attached to a first end of the main body, wherein the "summer" mode mail hatch service door has a friction fit door pull and catch design defining a water tight seam with the first end of the main body;

a "winter" mode mail hatch attached to a side of the main body, wherein the "winter" mode mail hatch cooperates with a hatch slot and reversed insert shaped flange on the side of the main body defining a water tight seam with the "winter" mode mail hatch; and a second end of the main body opposite the first end wherein the second end has a tubular, blunt bullet shape.

2. A mailbox according to claim 1 wherein the shaped plate of the main body further comprises one continuous welded seam located underneath the main body to join the first end and the second end.

3. A mailbox according to claim 1 further comprising a floor wherein the main body is configured to define a shell wherein the shell houses the floor.

4. A mailbox according to claim 3 wherein the shell has a left side wall and a right-side wall wherein the floor extends from the left side wall to the right side wall.

5. A mailbox according to claim 1 further comprising at least one red flag wherein the red flag is configured to rotate 90°.

6. A mailbox according to claim 1 wherein the tubular blunt bullet shape of the second end is a blunt dome shaped end.

7. A mailbox according to claim 6 wherein the second end is attached to the main body with a continuous braised seam.

8. A mailbox according to claim 1 further comprising a mailbox post comprising a bent pipe for rotating a mailbox from a "summer" position to a "winter" position.

9. A mailbox according to claim 8 further comprising at least one latch for locking the "summer" and "winter" positions.

10. A mailbox according to claim 9 wherein the at least one latch is a pull spring pop latch.

11. A mailbox according to claim 9 wherein the at least one latch is two pull spring pop latches.

12. A mailbox according to claim 9 wherein the post is a two inch diameter aluminum pipe bent to a shape.

13. A mailbox according to claim 12 wherein the shape of the bent pipe is an 'S' shaped curve.

14. A mailbox system resistant to damage comprising:

a mailbox resistant to damage wherein the mailbox comprises:

a main body of continuous round tube shaped plate defining an interior for receiving mail;

a "summer" mode mail hatch attached to a first end of the main body, wherein the "summer" mode mail hatch has a friction fit, water tight seam with the first end of the main body;

a "winter" mode mail hatch attached to a side of the main body, wherein the "winter" mode mail hatch has a friction fit, water tight seam with the side of the main body; and a second end of the main body opposite the first end wherein the second end has a tubular, bullet shape;

a mailbox post comprising a bent pipe for rotating the mailbox from a "summer" position to a "winter" position; and wherein the mailbox is attached to a top end of the mailbox post.

15. A mailbox system according to claim 14 wherein the "summer" mode mail hatch of the mailbox faces a roadway.

16. A mailbox system according to claim 14 wherein the "winter" mode mail hatch of the mailbox faces a roadway.

17. A mailbox system according to claim 14 further comprising a newspaper option tube attached to the mailbox post.

18. A mailbox system according to claim 17 wherein the newspaper option tube has a tubular, bullet shape.

* * * * *